United States Patent [19]

Oberst

[11] 4,296,564

[45] Oct. 27, 1981

[54] SEMI-AUTOMATIC RELOADING FIREARM

[75] Inventor: E. Ernest Oberst, Cheshire, Conn.

[73] Assignee: The Marlin Firearms Company, North Haven, Conn.

[21] Appl. No.: 49,347

[22] Filed: Jun. 18, 1979

[51] Int. Cl.[3] ..... F41C 27/12

[52] U.S. Cl. ..... 42/1 C

[58] Field of Search ..... 42/1 C

[56] References Cited

U.S. PATENT DOCUMENTS

| | | | |
|---|---|---|---|
| 16,288 | 12/1856 | Schroeder et al. | 42/1 C |
| 733,681 | 7/1903 | Schouboe | 42/1 C |
| 923,244 | 6/1909 | Chadwick | 42/1 C |

*Primary Examiner*—Charles T. Jordan

*Attorney, Agent, or Firm*—Walter Spruegel

[57] ABSTRACT

Semi-automatic reloading firearm is provided with a signal button which is normally urged into prominent projection from an aperture in the receiver to thereby foretell firing response of the firearm to the next pull on the trigger, and this signal button is operatively linked to the hammer of the firing mechanism so that on the firing stroke of this hammer the signal button is retracted into the aperture in the receiver to thereby foretell non-firing response of the firearm to the next trigger pull.

2 Claims, 6 Drawing Figures

SEMI-AUTOMATIC RELOADING FIREARM

This invention relates to repeating firearms in general, and to semi-automatic reloading firearms in particular.

The type of firearm with which the invention is concerned provides an action having a hammer, a breech bolt which is opened by the powder gases of a fired cartridge and closed by spring action, a cartridge magazine, and a device for feeding a cartridge from the magazine into the firing chamber on each cyclic operation of the breech bolt into its open and closed positions, with the hammer being also cocked by the breech bolt on each excursion to its open position so that the firearm is ready for firing on each cyclic operation of the breech bolt until the magazine is empty.

Firearms of this type do not afford any visual indication of their firing condition, i.e., whether or not a cartridge will be fired by the hammer on pulling the trigger, yet the cocked or non-cocked condition of the hammer should be known to any intended user of the firearm to thereby avoid any potentially hazardous situations. In this connection, while such a firearm is generally known to be ready for firing far more often than not, i.e., at all times except when the magazine is empty or there should for some reason occur a jam in the cartridge feed from the magazine to the firing chamber, any user of the firearm is often uncertain when the magazine is empty and is never certain of a possible jam in the cartridge feed, so that such user must be aware of conceivable non-firing response to any pull on the trigger despite the odds against it. This being the case, and if the firearm is to be fired only with prior certainty that its hammer is cocked for firing, recourse would have to be had to checking its firing condition in the only way possible under the circumstances, i.e., by opening the action on manually retracting the breech bolt from its closed position and from its resistance to such retraction determine the cocked or uncocked condition of the hammer, for a cocked hammer offers more resistance to opening the breech bolt than does a non-cocked hammer. Such checking of the firearm for the cocked or non-cocked condition of the hammer would, however, be impractical because it would impose an unreasonable burden on the user of the firearm and, even more important, would not even serve the purpose because if there were a live cartridge in the firing chamber the same would be retracted from the latter and probably be ejected from the receiver on such manual opening of the breech bolt. On the other hand, pulling the trigger to check the firing condition of the firearm would also be unthinkable, not only because it would be self-defeating in its intended purpose, but would also give rise to all the potential hazards involved in pulling the trigger with less than full expectation of firing a live cartridge and beforehand taking the necessary precautions for firing under the accustomed safety conditions. There is thus no ready and feasible way to check the firing condition of such a firearm.

There are also known locks in firearms of this type which operate to arrest the breech bolt on its arrival in open position in the course of an operating cycle thereof if there is then no cartridge in the magazine for its feed into the firing chamber, so that the open breech bolt signals an empty magazine and calls for reloading the same with live cartridges before the firearm can be used again. However, since these locks are manually operable to release the breech bolt in its open position for spring-return to its closed position regardless of whether or not the magazine has been reloaded with cartridges while the breech bolt was arrested in its open position, even such locks fail to indicate the firing condition of a firearm once the breech bolt is closed following its release in locked open position. This is all the more true since the reloading of an empty magazine with cartridges and subsequent closing of the breech bolt does not place a live cartridge into the firing chamber, and to do the latter requires either manual chambering of a cartridge through the side opening in the receiver and then releasing the open breech bolt for its spring-return to closed position, or manual cycling of the breech bolt once into open and closed positions following its spring-return to the latter position from its arrested open position for feeding the foremost cartridge in the reloaded magazine into the firing chamber in usual manner. Thus, the closed position of the breech bolt in a firearm with or without such a lock does not afford an indication per se whether the firearm is ready for firing, or is not ready for firing due to an empty magazine, or due to failure of chambering a cartridge following reloading of the magazine with cartridges, or due to a jam in the cartridge feed from the magazine to the firing chamber.

It is a primary object of the present invention to provide a firearm of this type with a signal which at a glance tells the user the condition of the firearm in point of its firing or non-firing response to the next pull on the trigger. Thus, the signal is mounted, preferably on the receiver and in any event within ready view of the user of the firearm. For movement into "firing" and "non-firing" positions in which to foretell firing and non-firing response of the firearm to the next trigger pull, with the signal being to this end operatively linked, significantly, to the firing mechanism so as to sense the firing or non-firing condition of the latter and be accordingly shifted to "firing" or "non-firing" position. With this arrangement, the featured signal on the firearm, by reflecting the true condition of the firing mechanism which is mostly hidden from view and affords no sight indication of its true condition, will compel the exercise of reliable safety precautions in handling, and particularly firing, the arm as forcefully as only sure knowledge of the actual firing condition of the firing mechanism will do. Thus, with the signal foretelling, for example, "non-firing" of the arm on the next trigger pull, this particular message of the signal will come true at all times. On the other hand, with the signal foretelling "firing" of the arm on the next trigger pull, this message of the signal will come true at all times except when the firing chamber is left empty following the firing of the last cartridge from the magazine or when the cartridge feed from the magazine to the firing chamber should become jammed on rare occasions. However, if a firearm with the present signal is also provided with a breech bolt lock as aforementioned, the "firing" message given by the signal will come true for all practical intents and purposes at all times, for a jam in the cartridge feed will hardly ever go unnoticed by the user of the firearm and chambering a cartridge is to most as indispensible in supplying the firearm with cartridges as is the reloading of the magazine.

It is a further object of the present invention to provide a firearm of this type with the aforementioned signal which is in the preferred form of a simple button that is normally spring-urged into prominent projection from an aperture in the receiver to spell firing response of the firearm to the next trigger pull, and the aforementioned operating linkage of this signal button with the firing mechanism is by way of a rocker which is carried by the breech bolt and normally spring-urged into a position in the path of the hammer on its firing stroke so as to be turned thereby from this position and thereby retract the signal button into the aperture in the receiver to spell non-firing response of the firearm to the next pull on the trigger.

Further objects and advantages will appear to those skilled in the art from the following, considered in conjunction with the accompanying drawings.

In the accompanying drawings, in which certain modes of carrying out the present invention are shown for illustrative purposes:

Figure 1:
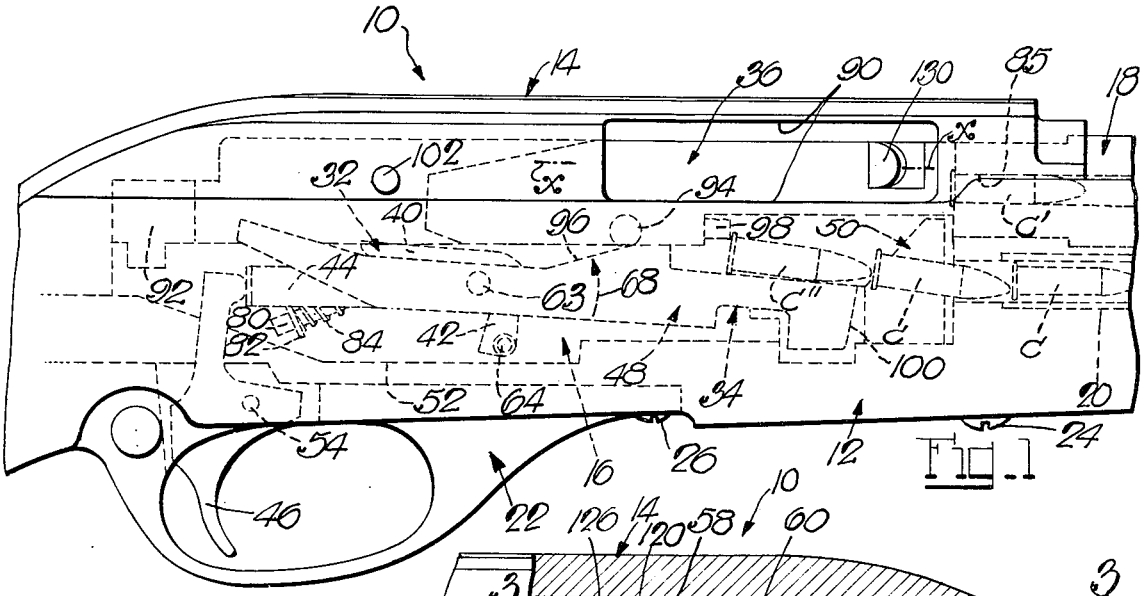
FIG. 1 is a fragmentary side view of a firearm embodying the invention.

Referring to the drawings, and more particularly to FIGS. 1 to 5 thereof, the reference numeral 10 designates a firearm of automatic reloader type having as its major components a stock 12, a receiver 14 with an action 16 therein, a barrel 18, a tube-type magazine 20, and a trigger guard 22. The receiver 14 and trigger guard 22 are suitably mounted in the stock 12 by screws 24 and 26, and the barrel 18 and magazine 20 are mounted in the forward end of the receiver 14. The magazine 20 has a usual spring (not shown) for the feed of cartridges c to the action 16.

The action 16 has as its major operating components a firing mechanism 32 and a cartridge transfer device 34. The firing mechanism 32 provides a breech bolt 36 with a firing pin 38, a hammer 40, a sear 42, a link 44 and a trigger 46, while the transfer device 34 provides a cartridge lifter 48 and a feed throat 50. All of these parts, except the trigger 46 and breech bolt 36 with its firing pin 38, are mounted on and between spaced side plates 52 and form therewith a preassembled unit, while the trigger 46 is at 54 pivoted in the guard 22, and the breech bolt 36 is received for movement in the direction of its axis x in a guideway 56 which is formed in the receiver 14 by the top and opposite side walls 58 and 60 thereof and by the top surfaces of the side plates 52. The hammer 40 and lifter 48 are pivoted on a common crosspin 63 between the side plates 52, and the sear 42 is pivoted on another crosspin 64 between the same plates, with the lifter being normally spring-urged in lift direction as indicated by the arrow 68 (FIG. 1), and the sear 42 being normally spring-urged into the position in FIG. 2 in which it is in interlock with a shoulder on the hammer 40 and holds the latter in its cocked position. The link 44 is suitably mounted for movement in opposite directions and bears with its forward end against the sear 42 to retract the latter from interlock with the cocked hammer 40 on pulling the trigger 46 against the force of its return spring (not shown). Pivotally connected at 78 with the hammer 40 is a link 80 which extends through and is slidable in a pivoted seat 82 for a preloaded spring 84 (FIGS. 1 and 2) which surrounds the link 80 and through the same forces the hammer into striking engagement with the firing pin 38 for firing the cartridge c′ in the firing chamber 85 when on the pull of the trigger the cocked hammer is released from the sear. The feed throat part 50 is also suitably mounted between the side plates 52, and the preassembled unit is, in turn, suitably mounted in the receiver 14.

The breech bolt 36 is normally urged by a spring (not shown) into the closed position shown in FIGS. 1 to 4, and the same carries at its forward end the usual extractors (not shown) which on rearward excursion of the breech bolt following the firing of the cartridge c′ extract the cartridge shell from the firing chamber 85 and eject it through the usual side port 90 in the receiver 14. Rearward excursion of the breech bolt 36 is responsive to firing a cartridge, the bolt being then blown rearwardly by the powder gases of the fired cartridge. Mounted in the receiver is a pad 92 of nylon or another nonmetallic material against which the blown-back breech bolt impacts with minimum noise.

Figure 2:
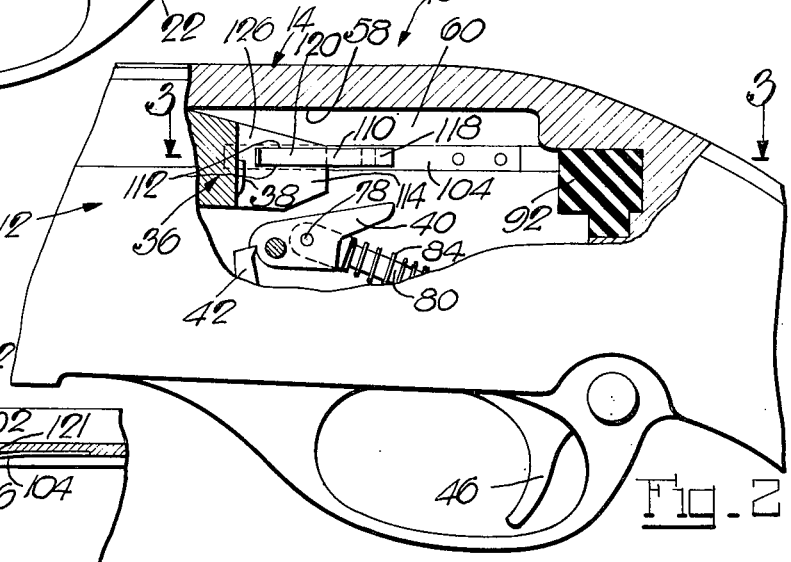
FIG. 2 is another fragmentary side view, partly in section, of the same firearm, with the section being taken on the line 2—2 of FIG. 3.

The firearm described so far may be entirely conventional and forms no part of the present invention except insofar as it enters into combination therewith. In its operation, the same is shown in FIGS. 1 and 2 in condition ready for firing. In this condition, a roller 94 in the closed breech bolt 36 cooperates with a cam formation 96 on the lifter 48 to hold the latter in its depressed position in which it is in lift relation with the last-admitted cartridge c″ in the feed throat 50. This latter cartridge is by the following spring-urged cartridges in the magazine 20 urged against a stop lug 98 in the throat 50 and thus stops the feed of an additional cartridge or cartridges from the magazine into the throat. On pulling the trigger 46, the chambered cartridge c′ will be fired, whereupon the breech bolt will by the powder gases be blown rearwardly against the force of its return spring (not shown) and will on impact with the pad 92 be immediately spring-returned to its closed position. During its rearward excursion in this manner, the breech bolt 36 will cam the hammer 40 into the depressed, cocked, position in FIG. 2 in which it will be locked by the sear 42, and the roller 94 on the breech bolt will cooperate with the cam formation 96 on the lifter 48 to permit spring-urged upswing of the latter during which it carries the cartridge thereon to the top of the feed throat 50 until stopped when this cartridge reaches a usual top lip (not shown) on the throat at which the cartridge is held in chambering relation with the retracted breech bolt. During such upswing of the lifter 48 a shoulder 100 thereon also holds the nearest cartridge from entering the throat. On the succeeding spring-closure of the breech bolt 36, the same will chamber the cartridge in its path in usual manner and also operate the lifter into its depressed position to admit the next cartridge into the throat 50 and into lift relation with the lifter, whereupon the firearm is again ready for firing, as will be readily understood. Thus, each pull on the trigger 46 will result not only in the firing of a chambered cartridge but also in the feed of the next cartridge from the magazine into the firing chamber, with the firearm being thus ready for firing a cartridge soon after firing the preceding cartridge until there are no more cartridges left in the magazine. The magazine may thereafter be recharged with live cartridges customarily through a side aperture (not shown) in the magazine tube.

Figure 4:
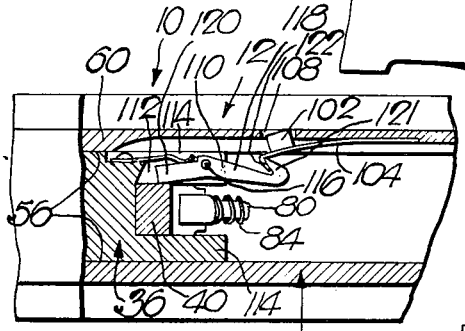
FIGS. 4 and 5 are fragmentary sections similar to FIG. 3, but showing the firearm in different conditions.
Figure 3:
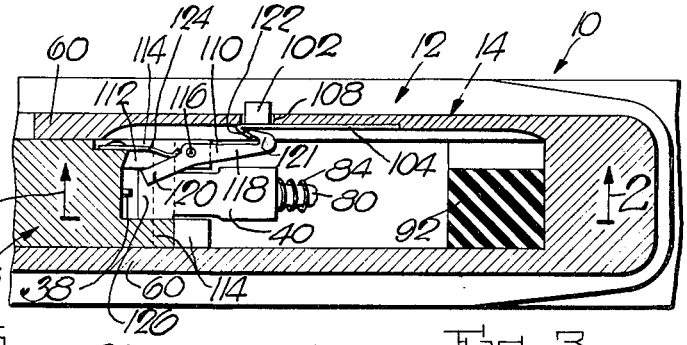
FIG. 3 is a fragmentary section through the firearm as taken substantially on the line 3—3 of FIG. 2.

It is characteristic of firearms of this type that all operating parts, except the breech bolt and trigger, are hidden from view, which gives rise to the aforementioned uncertainties about the firing condition of the firearm and the potentially hazardous situations resulting therefrom. In order to avoid such uncertainties about the firing condition of the firearm and thereby contribute largely to its safe and reliable use, the same is provided, in accordance with the invention, with a featured signal element 102 which is within sight of a user of the firearm and at a glance foretells firing or non-firing response of the firearm to the next pull on the trigger. The signal element 102 is in the preferred form of a simple button that assumes either of two different indicating positions which foretell firing and non-firing response of the firearm to the next trigger pull. To this end, the signal button 102 is carried by a suitably mounted leaf spring 104 on the inside of a sidewall 60 of the receiver 14, with the signal button extending into an aperture 108 in the receiver wall 60 and being by the spring 104 normally held in the projected position in FIG. 3 which is one of its indicating positions that denotes in this instance firing response of the firearm to the next trigger pull. The signal button is in its other indicating position retracted into the aperture 108 (FIG. 4) to denote non-firing response of the firearm to the next trigger pull, with the signal button being shifted from the indicating position in FIG. 3 into the indicating position in FIG. 4 by an actuator 110 which in this instance is in the simple form of a lever that is carried by, and hence movable with, the breech bolt 36. The actuator lever 110 is received in a slot 112 in one of the spaced rear prongs 114 on the breech bolt 36 and is pivoted to the latter as at 116. The actuator lever 110 has two arms 118 and 120 on opposite sides of its pivot support 116, of which the end of arm 118 is in the form of a hook 121 which in the closed position of the breech bolt is in inter-engagement with a hooked end 122 of the leaf spring 104 that carries the signal button 102 (FIGS. 3 and 4). The actuator lever 110 is by a spring 124 on the breech bolt 36 normally urged into the position shown in FIG. 3 in which its other arm 120 projects into the space 126 between the end prongs 114 on the breech bolt and into the path of the hammer 40 on its stroke against the firing pin 38 following its release from the sear 42 on pulling the trigger 46. Thus, assuming that there is a live cartridge in the firing chamber 85 and the breech bolt 36 is in its closed position, the firearm is then ready for firing (FIGS. 2 and 3) and this is unmistakably indicated to the user of the firearm by the projected position of the signal button (FIG. 3) which foretells firing response of the firearm to the next trigger pull. This message of firing response of the firearm to the next trigger pull by the signal button 102 in its projected position will come true at all times except when the last cartridge from the magazine has been fired. However, if the firearm should also be provided with a breech bolt lock as explained earlier, the firing response message of the signal button in its projected position in FIG. 3 will come true for all practical intents and purposes at all times as aforementioned.

With the firearm ready for firing as in FIG. 3, the then chambered cartridge will be fired on pulling the trigger 46 and thereby retracting the sear 42 from interlock with the cocked hammer 40 for its stroke against the firing pin 38 in the course of which the hammer cams the arm 120 of the actuator lever in its path out of the way (FIG. 4) with ensuing retraction of the signal button 102 into the aperture 108 in the receiver. However, such retraction of the signal button 102 into the aperture 108 is only momentary, for the actuator lever 110 is with its arm 120 spring-urged into the space 126 between the end prongs 114 on the breech bolt (FIG. 5) when on the following retraction of the breech bolt from closed position the same returns the hammer 40 to its cocked position, and the actuator lever 110 then remains with its arm 120 projecting into the space 126 between the end prongs 114 on the breech bolt on the following spring-return of the latter to its closed position (FIGS. 2 and 3) when the firearm is again ready for firing as then correctly foretold by the signal button 102 in its projected position. However, if the signal button 102 should remain retracted in the aperture 108 in the receiver as in FIG. 4, this is a sure indication of non-firing response of the firearm to the next trigger pull. Thus, the signal button 102 will indicate such non-firing response of the firearm to the next trigger pull when the trigger is pulled following the firing of the last cartridge from the magazine and in the absence of placing a live cartridge into the firing chamber either by hand through the side port 90 in the receiver on manually retracting the breech bolt at its handle 130, or on manually cycling the breech bolt into its open and closed positions following reloading of the magazine with cartridges.

Figure 6:
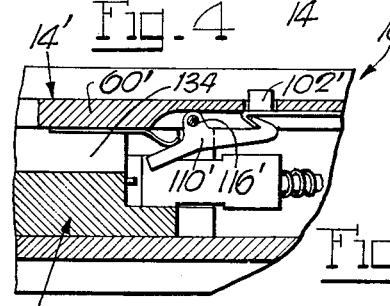
FIG. 6 is a fragmentary section through a firearm embodying the invention in a modified manner.
Figure 5:
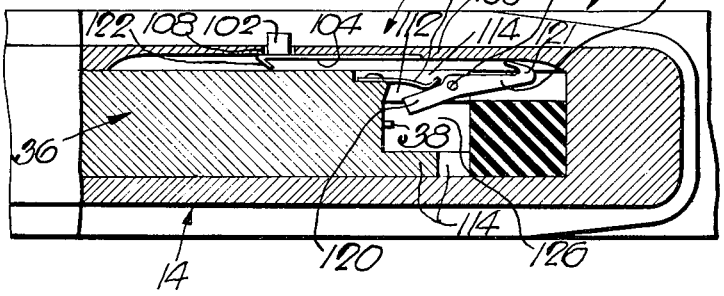

While in the described firearm 10 of FIGS. 1 to 5 the actuator lever for the featured signal button is carried by, and hence movable with, the breech bolt, FIG. 6 shows a modified firearm 10' in which the actuator lever 110' for the signal button 102' is carried by the receiver 14', and is to this end pivotally mounted at 116' in the sidewall 60' of the receiver, with the breech bolt 36' having a longitudinal side groove 134 to clear the actuator lever 110' on its excursions into open and closed position.

I claim:

1. In a firearm having a receiver member, a firing chamber, a breech bolt member spring-urged into closed position and retracted therefrom into open position by the powder gases of a fired cartridge, a cartridge magazine, a device for feeding a cartridge from the magazine into the firing chamber on each cycle of the breech bolt member into open and closed position, a hidden hammer in said receiver member moved into cocked position by the breech bolt member on its retraction from closed position and spring-advanced into firing position on release in its cocked position, and means including a trigger for releasing said hammer in its cocked position on pulling the trigger, the combination of a visible signal element movable on the receiver member, and an actuator pivoted on said breech bolt member for turning movement thereon, with said actuator being spring-urged into a first position in the path of said hammer to be cammed thereby into a second position on the advance of said hammer into firing position, and said signal element is in and out of follower relation with said actuator in said closed and open positions, respectively, of said breech bolt member, with said signal element when in follower relation with said actuator assuming in said first and second actuator positions corresponding first and second positions denoting firing and non-firing response, respectively, of said hammer to the next trigger pull.

2. The combination in a firearm as in claim 1, in which said signal element is a button which in said first position projects from an aperture in the receiver member and in said second position is retracted into said aperture, said button is carried by a leaf spring mounted in said receiver member and normally urging said button into said first position, said actuator is pivoted on said breech bolt member so as to be turnable into said first and second positions, and said actuator and leaf spring are provided with hook formations interengaged with and disengaged from each other on movement of said breech bolt member into said closed and open positions, respectively, for bringing said actuator into and from follower relation, respectively, with said button.

* * * * *